US011446703B2

(12) United States Patent
Currey

(10) Patent No.: US 11,446,703 B2
(45) Date of Patent: Sep. 20, 2022

(54) BUCKET WITH VIBRATING SCREEN

(71) Applicant: Albert Ben Currey, Phoenix, AZ (US)

(72) Inventor: Albert Ben Currey, Phoenix, AZ (US)

( * ) Notice: Subject to any disclaimer, the term of this patent is extended or adjusted under 35 U.S.C. 154(b) by 0 days.

(21) Appl. No.: 17/207,069

(22) Filed: Mar. 19, 2021

(65) Prior Publication Data

US 2021/0205849 A1 Jul. 8, 2021

Related U.S. Application Data

(63) Continuation-in-part of application No. 29/747,913, filed on Aug. 26, 2020, now Pat. No. Des. 943,009, which is a continuation of application No. 16/675,853, filed on Nov. 6, 2019, now abandoned.

(51) Int. Cl.

| | |
|---|---|
| ***E02F 3/14*** | (2006.01) |
| ***B07B 1/36*** | (2006.01) |
| ***B07B 1/00*** | (2006.01) |

(52) U.S. Cl.

CPC ..... *B07B 1/36* (2013.01); *B07B 1/005* (2013.01)

(58) Field of Classification Search

CPC ... E02F 3/141; E02F 3/40; E02F 3/405; E02F 3/407; B07B 1/005; B07B 1/36; B07B 1/4609; B07B 1/50; B07B 2201/02

See application file for complete search history.

(56) References Cited

U.S. PATENT DOCUMENTS

| | | | | |
|---|---|---|---|---|
| 3,765,490 | A | 10/1973 | Logue | |
| 3,834,534 | A | 9/1974 | Peterson | |
| 4,157,956 | A * | 6/1979 | Robinson | B07B 1/10 209/260 |
| D332,271 | S | 1/1993 | DuBose | |
| 5,240,366 | A | 8/1993 | Bamford | |
| 5,398,430 | A | 3/1995 | Scott | |
| D357,260 | S | 4/1995 | Kallen | |
| 5,493,796 | A | 2/1996 | Ballew et al. | |
| 5,531,561 | A | 7/1996 | Rae | |
| 5,771,612 | A | 6/1998 | Lynch | |
| 5,984,618 | A | 11/1999 | Deneve | |
| D425,527 | S | 5/2000 | Deyo | |
| D437,602 | S | 2/2001 | Hiraoka | |
| 6,364,119 | B1 | 4/2002 | Graham | |
| 6,375,012 | B1 | 4/2002 | Leyland et al. | |
| 6,408,551 | B1 | 6/2002 | Pettersson | |
| D460,975 | S | 7/2002 | Yanagida | |
| 6,725,942 | B2 | 4/2004 | Stevens | |
| 6,834,447 | B1 * | 12/2004 | Currey | E02F 7/06 37/142.5 |
| 7,066,275 | B1 | 6/2006 | Keigley | |
| D534,552 | S | 1/2007 | Yanagida | |

(Continued)

*Primary Examiner* — Joseph C Rodriguez

(74) *Attorney, Agent, or Firm* — Schmeiser, Olson & Watts, LLP

(57) ABSTRACT

A bucket with a vibrating screen is provided. The bucket includes a bucket member having an inner volume. The bucket member includes an first portion having a first opening to access the inner volume and a tapered second portion having a second opening to access the inner volume. The second opening is smaller than the first opening. The bucket includes a screen removably coupled to the bucket member within the inner volume in a location between the first portion and the second portion. The bucket includes a vibration generation device coupled to the screen.

16 Claims, 5 Drawing Sheets

(56) References Cited

U.S. PATENT DOCUMENTS

| | | | | |
|---|---|---|---|---|
| 7,204,046 | B2 | 4/2007 | Currey | |
| 7,445,122 | B2 | 11/2008 | Currey | |
| 7,549,544 | B1 | 6/2009 | Currey | |
| 7,591,379 | B2 | 9/2009 | Turnbull | |
| D616,469 | S | 5/2010 | Ballinger | |
| D623,671 | S | 9/2010 | Bolyard | |
| 8,069,591 | B2 | 12/2011 | Dunn | |
| 8,112,913 | B2 * | 2/2012 | Sirr | E02F 7/06 37/444 |
| 8,360,249 | B1 | 1/2013 | Currey | |
| 8,893,409 | B1 | 11/2014 | Rossi, Jr. | |
| 9,080,314 | B1 * | 7/2015 | Rossi, Jr. | B07B 1/46 |
| D748,157 | S | 1/2016 | Phillips | |
| D752,655 | S | 3/2016 | Morinaga | |
| 9,546,467 | B2 | 1/2017 | Paski | |
| 9,631,340 | B2 | 4/2017 | Zimmerman | |
| D788,181 | S | 5/2017 | Deleon | |
| 9,644,342 | B1 | 5/2017 | Meyers | |
| D840,439 | S | 2/2019 | Schlesser | |
| D881,239 | S | 4/2020 | Gregory | |
| 11,103,894 | B2 * | 8/2021 | Azzolin | B07B 1/005 |
| D943,009 | S | 2/2022 | Currey | |
| 2004/0040724 | A1 | 3/2004 | Stevens | |
| 2014/0079520 | A1 * | 3/2014 | Kent | E02F 3/40 414/722 |
| 2016/0177537 | A1 | 6/2016 | Krell | |
| 2020/0199846 | A1 | 6/2020 | Dunstan | |

* cited by examiner

BUCKET WITH VIBRATING SCREEN

CROSS REFERENCE TO RELATED APPLICATION[S]

This application is a continuation-in-part of the earlier U.S. Design patent application Ser. No. 29/747,913, filed Aug. 26, 2020, which is a continuation of the earlier U.S. Utility patent application Ser. No. 16/675,853, filed Nov. 6, 2019, the disclosures of which are hereby incorporated entirely herein by reference.

BACKGROUND OF THE INVENTION

Technical Field

This invention relates generally to screening bucket and more particularly to a bucket with a vibrating screen.

State of the Art

The separation of smaller material from larger material is common in instances such as excavation wherein the smaller material is desired at one location and the larger material is desired to be at a second location. This is commonly performed in a process that requires several steps to complete.

For example, a vehicle such as, but not limited to a hydraulic excavator, backhoe or loader applications, may use a bucket or other device to collect a particular amount of material. The material may be deposited into a separating device, such as a screen or disc screen separator. The smaller material is separated from the larger material. The smaller material may then be transported to a first location and the larger material may be transported to a second location. There are several limitations to these common or conventional forms of separating smaller material from larger material.

One limitation includes having multiple pieces of equipment to perform the separation of the material. A vehicle is required to collect the material. A separating device then separates the smaller material from the larger material. A vehicle may be employed to deliver the smaller material to a first location and another vehicle may be employed to deliver the larger material to second location. This creates a time-consuming process of separating material.

Accordingly, there is a need for an improved separating device such as a bucket with a vibrating screen.

SUMMARY OF THE INVENTION

An embodiment includes a bucket with a vibrating screen comprising: a bucket member having an inner volume, the bucket member comprising: an first portion having a first opening to access the inner volume; and a tapered second portion having a second opening to access the inner volume, wherein the second opening is smaller than the first opening; a screen removably coupled to the bucket member within the inner volume in a location between the first portion and the second portion; and a vibration generation device coupled to the screen.

Another embodiment includes A method of using a bucket with a vibrating screen, the method comprising: coupling the bucket with the vibrating screen to an excavator, the bucket comprising: a bucket member having an inner volume, the bucket member comprising: an first portion having a first opening to access the inner volume; and a tapered second portion having a second opening to access the inner volume, wherein the second opening is smaller than the first opening; a screen removably coupled to the bucket member within the inner volume in a location between the first portion and the second portion; and a vibration generation device coupled to the screen; filling the bucket member with material through the first opening and retaining the material on the screen; operating the vibration generation device to vibrate the screen; screening material through the screen in response to vibration of the screen; and directing the screened material through the tapered second portion and out of the second opening onto a desired location.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
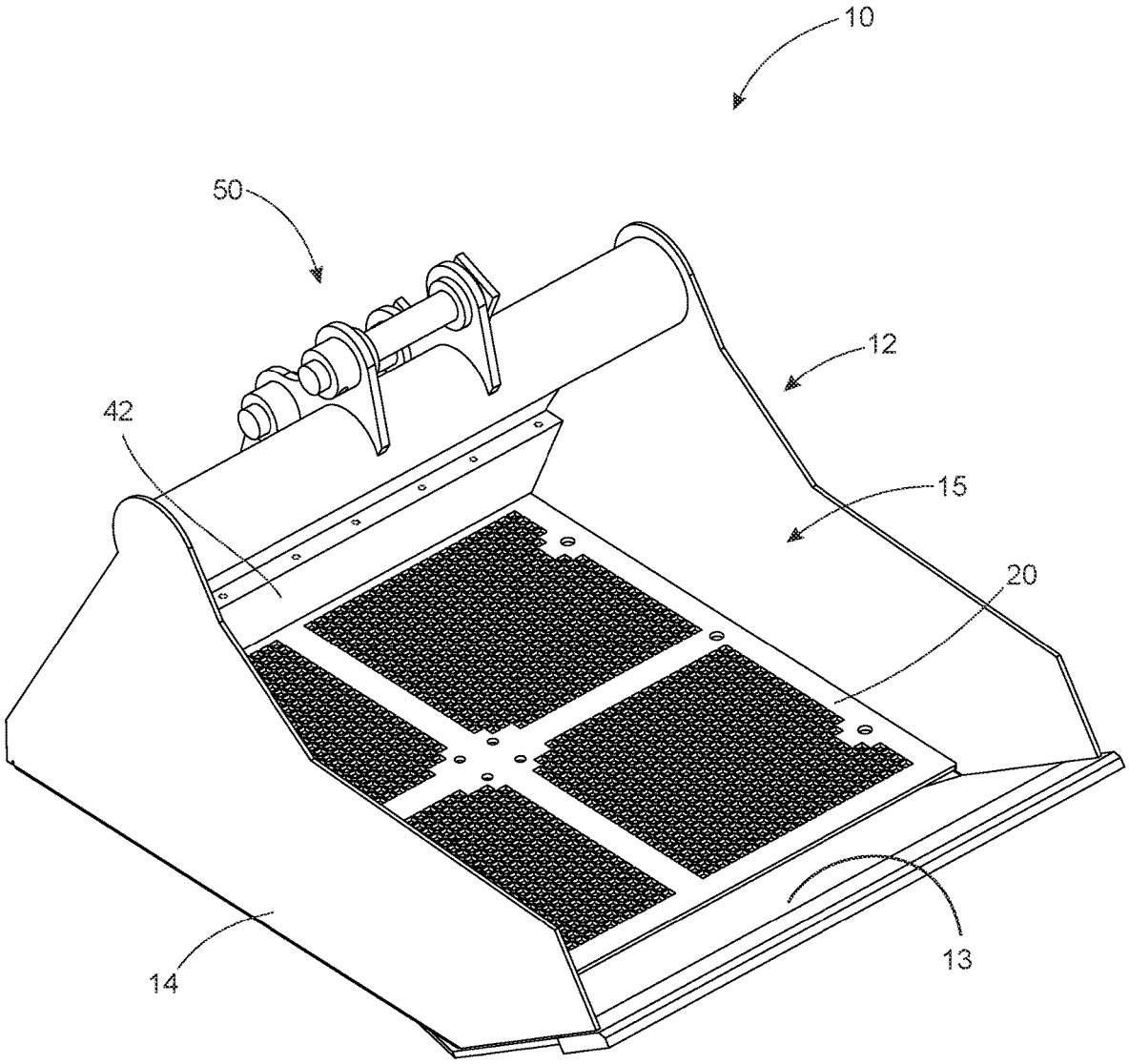
FIG. 1 is a top perspective view of a bucket with a vibrating screen in accordance with an embodiment.
Figure 2:
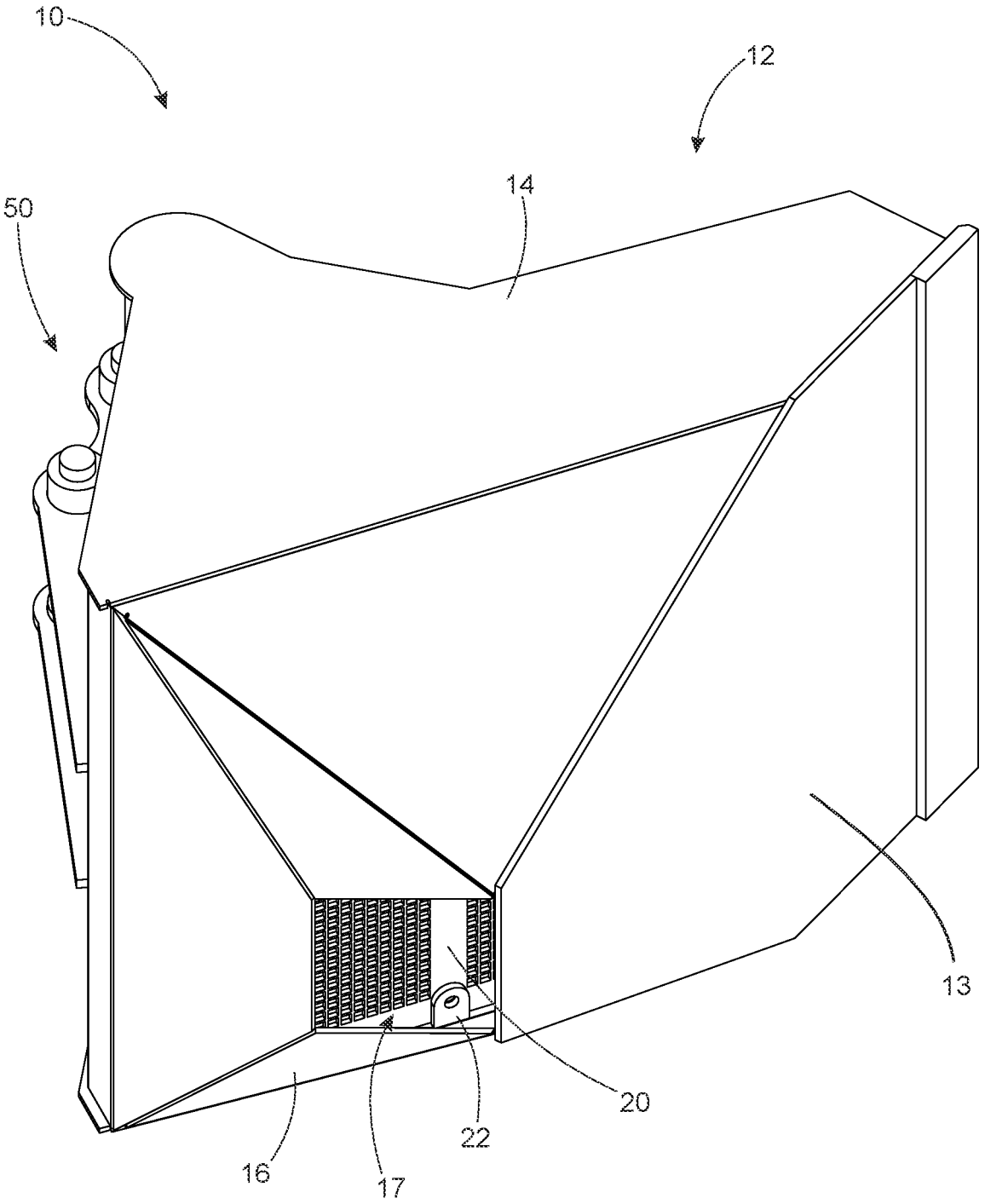
FIG. 2 is a bottom perspective view of a bucket with a vibrating screen in accordance with an embodiment.
Figure 3:
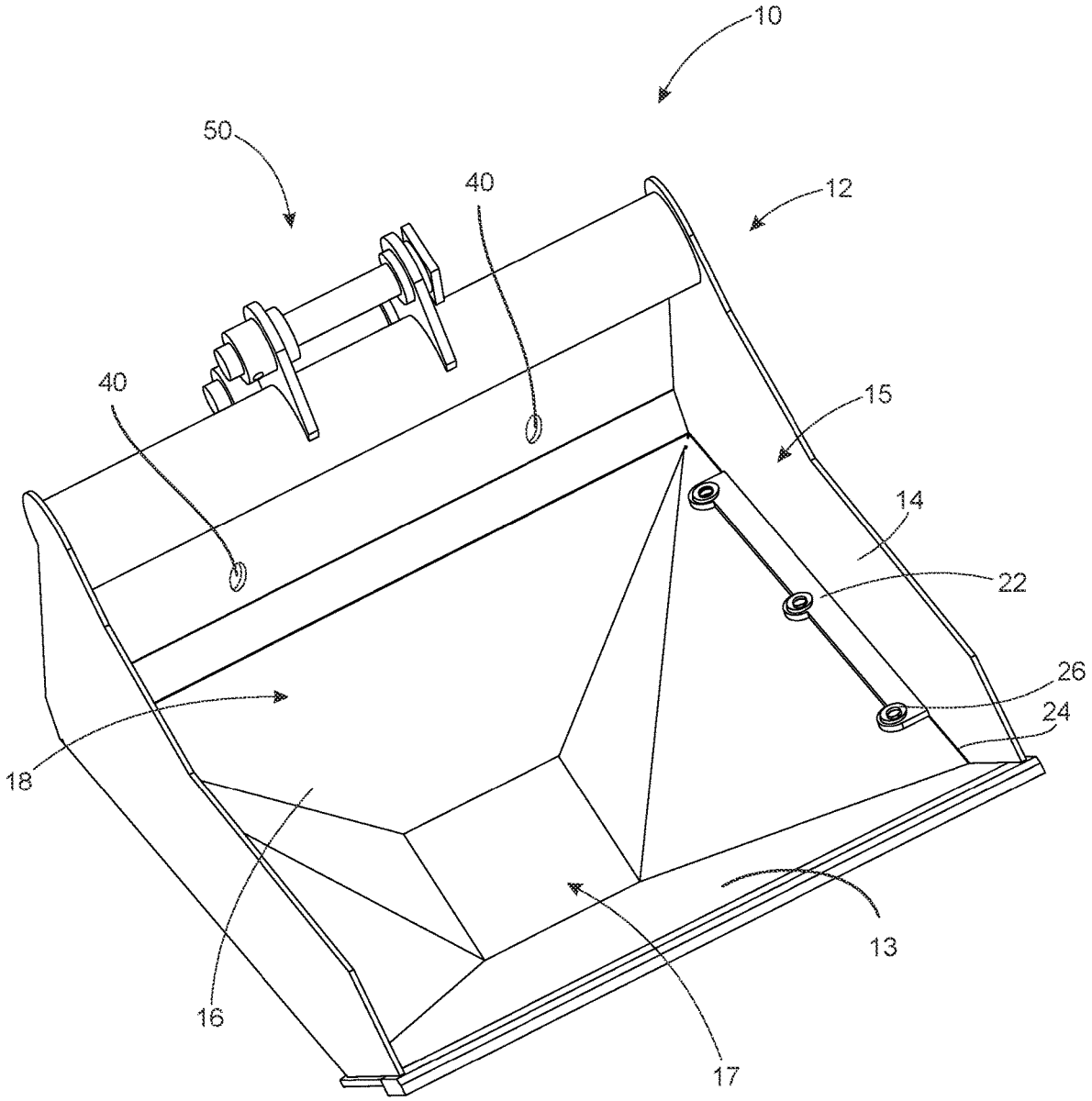
FIG. 3 is a top perspective view of a bucket of FIG. 1 with the vibrating screen removed in accordance with an embodiment.
Figure 4:
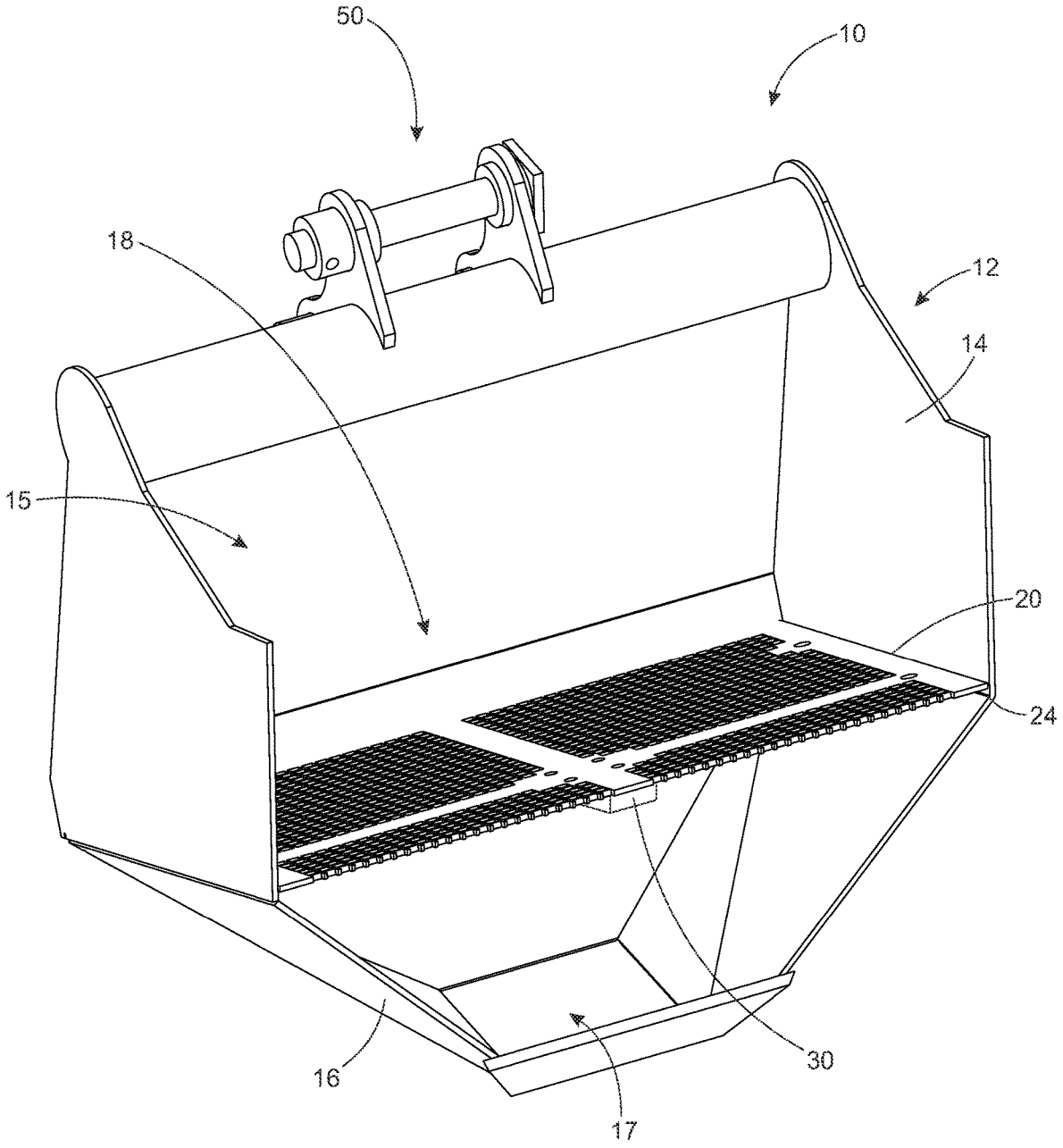
FIG. 4 is a perspective section view of a bucket with a vibrating screen in accordance with an embodiment.

As discussed above, embodiments of the present invention relate to a bucket with a vibrating screen. The bucket with a vibrating screen operates to screen material through the screen and deposit the screened material in a desired location.

Referring to FIGS. 1-4, an embodiment of a bucket 10 with vibrating screen is depicted. The bucket 10 comprises a bucket member 12 having an inner volume 18. The bucket member 12 may comprise a first portion 14 having a first opening 15 to access the inner volume 18. The bucket member 12 may comprise a tapered second portion 16 having a second opening 17 to access the inner volume 18. The second opening 17 is smaller than the first opening 15. The bucket 10 further comprises a screen 20 removably coupled to the bucket member 12 within the inner volume 18. The screen 20 may be coupled to the bucket member 12 in a location 24 between the first portion 14 and the second portion 16. The bucket 10 may also comprise a vibration generation device 30 coupled to the screen 20. Additionally, the bucket 10 may include components 50 four coupling the bucket member 12 to a vehicle (not shown). The vehicle may include an excavator, backhoe, loader or the like.

The first portion 14 of the bucket member 12 may include a flat tapered bottom member 13 that extend from the first portion 14 through the second portion 16, and the remainder of the first portion 14 may be formed of three other walls. The second portion 16 of the bucket member 12 may comprise a plurality of surfaces, including the flat tapered bottom member 13, extending from the first portion 14 to the second opening 17. Each of the plurality of surfaces are angled from the first portion 14 to the second opening 17 in order to form the tapered second portion 16.

The bucket 10 may comprise one or more brackets 22 coupled to the bucket member 12 within the inner volume 18. The brackets 22 may be coupled in the location 24 between the first portion 14 and the second portion 16. The screen 20 may be coupled to the one or more brackets 22. In embodiments, the bucket 10 may include at least one dampener 26 coupled between the bucket member 12 and the screen 20. This may be accomplished by locating the at least one dampener between the one or more brackets 22 and the screen 20.

With regard to the vibration generation device 30, the vibration generation device 30 may be coupled directly to the screen 20. In embodiments, the vibration generation device 30 may be an electric vibration device, may be a hydraulic vibration generating device, or the like.

The bucket member 12 may include apertures 40 extending through a surface of the bucket member 12. In embodiments, the surface is the surface utilized to couple to a vehicle. The apertures 40 operate to receive hoses, such as electrical or hydraulic hoses therethrough to supply power or hydraulic fluid to the vibrating device. The bucket member may also include a shield member 42 coupled within the inner volume to shield the hoses and other fittings that may utilized to supply hydraulic fluid or power to the vibrating device.

Figure 5:
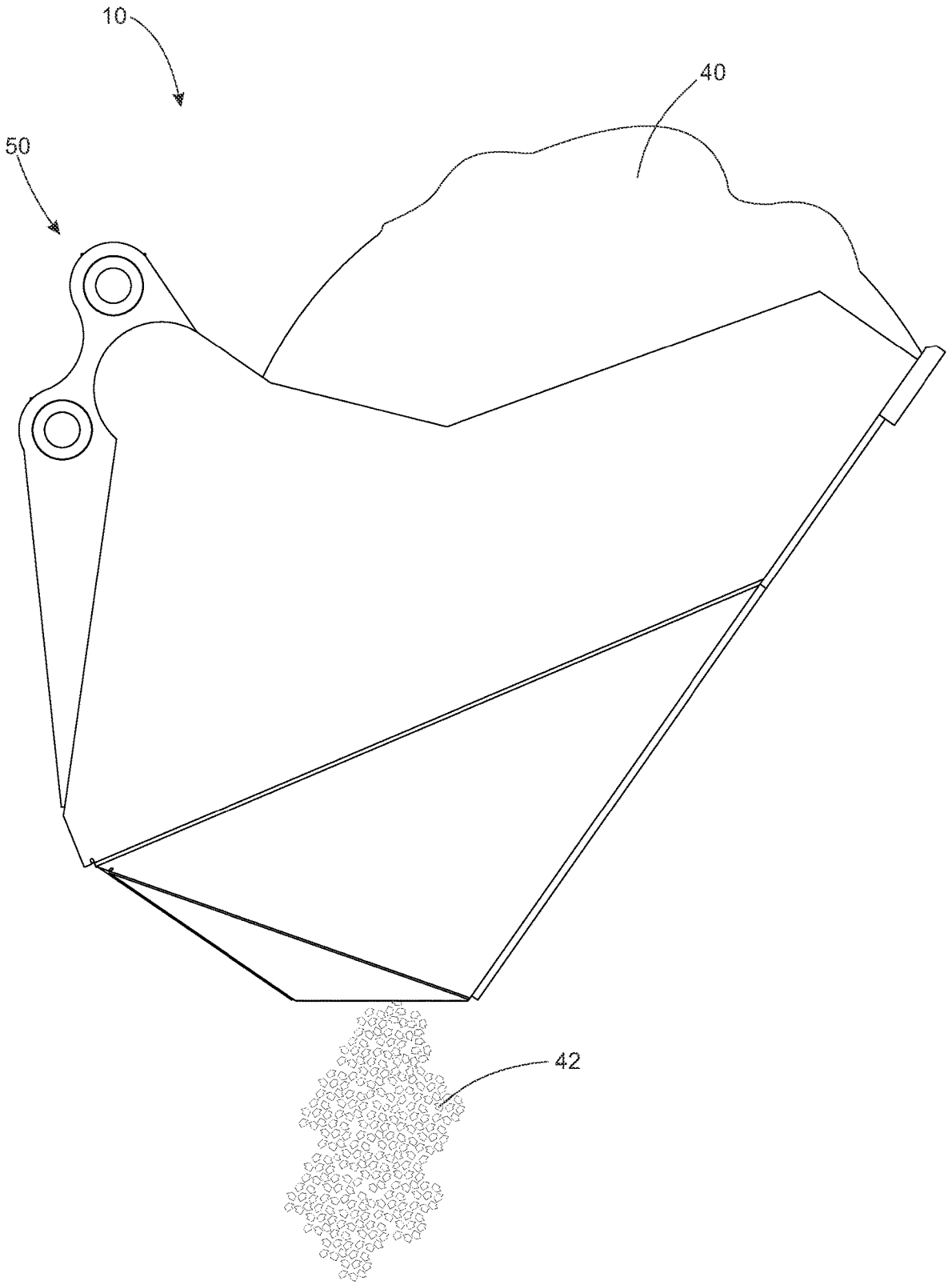
FIG. 5 is a side view of a bucket with a vibrating screen operating to screen material in accordance with an embodiment

Referring further to the drawings, FIG. 5 depicts a method of using a bucket 10 with a vibrating screen. The method comprises coupling the bucket 10 with the vibrating screen to an excavator; filling the bucket member 12 with material 50 through the first opening 15 and retaining the material 50 on the screen 20. The method further includes operating the vibration generation device 30 to vibrate the screen 20. The method includes screening material 50 through the screen 20 in response to vibration of the screen 20 and directing screened material 52 through the tapered second portion 16 and out of the second opening 17 onto a desired location. More specifically, the method includes coupling the bucket with the vibrating screen to a vehicle, the bucket having a first portion and a tapered second portion separated by the vibrating screen; filling the bucket member at a first location with material and retaining the material on the screen within the first portion; moving the bucket to a second location; operating the vibrating screen to screen material through the vibrating screen, wherein material sized to fit through the screen and retaining larger material on top of the screen; and controlled directing of screened material through the tapered second portion controlling placement of the screened material at the second location. Controlled directing of screened material includes screened material, after travelling through the vibrating screen, travels through the tapered portion through the second opening and limited spread of the screened material when leaving the tapered portion, and thereby providing a control of placement of the screened material to a particular spot. The controlled directing is unique above conventional and existing screening buckets. These conventional and existing screening buckets include a screen located at an end of the bucket, such that material exits the bucket immediately after exiting the screen. Such screening buckets do not control the placement of the screened material, but rather the material is spread wider than the bucket and in all directions. In at least this way, the screened material leaving the tapered portion is a controlled placement of material in a smaller spot than the material screened through conventional or existing screening buckets.

The method may further comprise dampening the screen 20 during vibration. This may be accomplished by the location of the damper(s) between the bucket member 12 and the screen 20. In the method, operating the vibration generation device 30 may further comprise flowing hydraulic fluid through the vibration generation device 30.

It will be understood that the tapered second portion 16 and the second opening 17 operate for precise depositing of the screened material 52. The deposit of screened material 52 may be precise with respect to a standard screening bucket, wherein the standard screening bucket does not include a tapered portion.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A method of using a bucket with a vibrating screen, the method comprising:

coupling the bucket with the vibrating screen to a vehicle, the bucket comprising a first portion with a first opening and a tapered second portion, wherein the vibrating screen is coupled to the first portion and separates the first portion and the second portion, and wherein the tapered second portion forms a funnel with a rectilinear second opening at an end of the funnel, wherein the second opening is smaller than the first opening;

filling the bucket member at a first location with material and retaining the material on the screen within the first portion;

moving the bucket to a second location;

operating the vibrating screen to screen material through the vibrating screen, wherein material sized to fit through the screen and retaining larger material on top of the screen; and controlled directing of screened material through the funnel and out the rectilinear second opening and controlling placement of the screened material at the second location.

2. The method of claim 1, wherein the bucket member further comprises:

a flat bottom member extending in a plane from the first opening to the second opening, the flat bottom member forming part of the first portion and forming part of the second portion; and a vibration generation device coupled to the screen.

3. The method of claim 1, further comprising dampening the screen during vibration.

4. The method of claim 1, wherein operating the vibration generation device comprises flowing hydraulic fluid through the vibration generation device.

5. A bucket with a vibrating screen comprising:

a bucket member having an inner volume, the bucket member comprising:

a first portion having a first opening to access the inner volume;

a tapered second portion comprising a rectilinear second opening to access the inner volume, wherein the second rectilinear opening is smaller than the first opening; and a flat bottom member extending in a single plane from the first opening to the rectilinear second opening, the flat bottom member forming part of the first portion and forming part of the second portion, wherein the tapered second portion forms a funnel with the rectilinear second opening at an end of the funnel;

a screen removably coupled to the first portion of the bucket member within the inner volume in a location between the first portion and the second portion; and a vibration generation device coupled to the screen.

6. The bucket of claim 5, wherein the second portion comprises a plurality of surfaces extending from the first portion to the second opening.

7. The bucket of claim 5, further comprising brackets coupled to the bucket member in the location between the first portion and the second portion.

8. The bucket of claim 7, wherein the screen is coupled to the brackets.

9. The bucket of claim 8, further comprising dampeners coupled between the bucket and the screen.

10. The bucket of claim 9, wherein the dampeners are coupled between the brackets and the screen.

11. The bucket of claim 5, wherein the vibration generation device is coupled directly to the screen.

12. The bucket of claim 5, wherein the vibration generation device comprises a hydraulic vibration generating device.

13. The method of claim 1, wherein controlled directing of screened material occurs after travelling through the vibrating screen.

14. The method of claim 13, wherein controlling placement of screened material at the second location further comprises limiting the spread of screened material leaving the bucket by controlling placement of material exiting the funnel in a spot smaller than a spot material placed by a conventional bucket with a screen located at an end of the conventional bucket whereby material exits the conventional bucket immediately after exiting the screen.

15. The method of claim 2, wherein the flat bottom member extending in a plane from the first opening to the second rectilinear opening and at least three additional surfaces extend from the first portion to the second rectilinear opening at an angle to form the funnel.

16. The method of claim 2, wherein the flat bottom member extending in a plane from the first opening to the second rectilinear opening and at least five additional surfaces extend from the first portion to the second rectilinear opening at an angle to form the funnel, wherein the second rectilinear opening is defined by three of the additional surfaces and the flat bottom member.

* * * * *